US007997707B2

(12) United States Patent
Shimizu et al.

(10) Patent No.: US 7,997,707 B2
(45) Date of Patent: Aug. 16, 2011

(54) LIQUID EJECTION DEVICE

(75) Inventors: Yoichiro Shimizu, Kasugai (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 703 days.

(21) Appl. No.: 12/057,017

(22) Filed: Mar. 27, 2008

(65) Prior Publication Data

US 2009/0201351 A1 Aug. 13, 2009

(30) Foreign Application Priority Data

Mar. 29, 2007 (JP) ..... 2007-086886

(51) Int. Cl.
*B41J 2/175* (2006.01)

(52) U.S. Cl. ..... 347/87; 347/85; 347/86

(58) Field of Classification Search ..... 347/85–87, 347/49

See application file for complete search history.

(56) References Cited

U.S. PATENT DOCUMENTS

| | | | | |
|---|---|---|---|---|
| 5,509,140 | A * | 4/1996 | Koitabashi et al. | 347/86 |
| 5,619,238 | A * | 4/1997 | Higuma et al. | 347/86 |
| 5,963,237 | A | 10/1999 | Ikkatai et al. | |
| 6,022,102 | A | 2/2000 | Ikkatai et al. | |
| 6,234,615 | B1 * | 5/2001 | Tsukuda | 347/85 |
| 6,276,784 | B1 | 8/2001 | Ikkatai et al. | |
| 6,585,360 | B1 * | 7/2003 | Dietl | 347/86 |
| 6,719,415 | B1 | 4/2004 | Hattori et al. | |
| 6,805,434 | B2 * | 10/2004 | Hayashi et al. | 347/85 |
| 7,185,974 | B2 | 3/2007 | Katayama | |
| 7,185,976 | B2 * | 3/2007 | Inoue et al. | 347/86 |

FOREIGN PATENT DOCUMENTS

| | | | |
|---|---|---|---|
| JP | H10-029318 | A | 2/1998 |
| JP | H11-170558 | A | 6/1999 |
| JP | 2001-063090 | A | 3/2001 |
| JP | 200566906 | A | 3/2005 |
| JP | 2005-161637 | A | 6/2005 |

OTHER PUBLICATIONS

Japan Patent Office; Notification of Reason for Refusal in Japanese Patent Application No. 2009-195696 (counterpart to the above-captioned U.S. patent application) mailed Dec. 8, 2009 (partial translation).

Japanese Patent Office, Office Action issued in corresponding Japanese Application No. 2007-086886, dated Jan. 27, 2009.

* cited by examiner

*Primary Examiner* — Ellen Kim
(74) *Attorney, Agent, or Firm* — Baker Botts L.L.P.

(57) ABSTRACT

A liquid cartridge is removably mountable to a liquid ejection device of one aspect of the invention. The liquid cartridge includes a sub tank having: a liquid inflow port; a liquid outlet port; a liquid inflow chamber configured to communicate with the outside of a main unit through the liquid inlet port, the liquid inflow chamber allowing the liquid to be supplied from the liquid cartridge through the liquid inflow port; a second liquid storage chamber configured to communicate with the liquid inflow chamber through a second communicating port, the liquid stored in the second liquid storage chamber being allowed to flow out to a liquid ejection head through the liquid outflow port; and an atmosphere opening port. The second communicating port and the liquid outflow port are positioned lower than the liquid supply port.

6 Claims, 6 Drawing Sheets

LIQUID EJECTION DEVICE

CROSS-REFERENCE TO RELATED APPLICATIONS

This application is based upon and claims the benefit of priority from Japanese Patent Application No. 2007-086886, filed on Mar. 29, 2007, the entire contents of which are incorporated herein by reference.

TECHNICAL FIELD

The present invention relates to a liquid ejection device to which a liquid cartridge is removably mountable.

BACKGROUND

An inkjet printer is known as a representative example of a liquid ejection device. The inkjet printer includes: a main printer unit including a mounting unit to which an ink cartridge is removably mounted, a head configured to eject ink, and an ink supplying path configured to supply ink to the head; and the ink cartridge removably mounted to the mounting unit of the main printer unit. The ink cartridge has an ink storage space defined therein, an ink supplying port configured to allow the ink to be supplied from the ink storage space to an outside of the ink cartridge, and an atmosphere communicating port configured to introduce an atmosphere into the ink storage space.

In the inkjet printer, air may enter into the ink supplying path even when the ink cartridge is not mounted in the process of mounting or removing the ink cartridge. For example, JP-A-2005-66906 discloses an inkjet printer (main printer unit) including a sub tank opened to the atmosphere and disposed between the ink cartridge and the ink supplying path so that air does not enter into ink supplying path even when the ink in the ink cartridge is used up. This sub tank has an internal space configured to store the ink, an ink inflow port connected to the ink supplying port of the ink cartridge in a state where the cartridge is mounted, an ink outflow port connected to an upstream end of the ink supplying path, and an atmosphere opening port configured to allow the internal space to communicate with the atmosphere.

SUMMARY

Generally, when the ink cartridge is mounted to the mounting unit of the inkjet printer, the ink supplying port is connected to the ink supplying path, thereby allowing the ink inside the ink cartridge flow into the ink supplying path. Therefore, a flow path leading from the ink supplying port to ink nozzles of the head through the ink supplying path is filled with the ink at all times. When the ink is ejected from the ink nozzles, ink of an amount corresponding to the ejected amount flows from the ink cartridge to the ink supplying path. When a liquid level in the ink cartridge falls to the ink supplying port, since air introduced from the atmosphere communicating port enters into the ink supplying path, ink cannot be supplied into the ink supplying path. When the ink supplying port is disposed at a bottom surface of an internal space (a surface at the lowest position of the internal space) of the ink cartridge, air does not enter until the ink is used to depletion. However, when the ink supplying port is disposed at a side surface of the internal space of the ink cartridge, the ink cartridge has to be replaced with a new cartridge even though ink remained below the ink supplying port. To resolve this problem, the inventors proposes an ink cartridge including an ink supplying chamber configured to communicate with the ink supplying port, and an ink storage chamber as a separate chamber from the ink supplying chamber, which are partitioned in an internal space of the ink cartridge. These chambers communicate with each other via a communicating port, and the communicating port is positioned lower than the ink supplying port. According to this ink cartridge, even when the ink level falls below the ink supplying port, air does not enter the ink supplying path as long as the ink level is higher than the communicating port, which provides enhanced ink depleting performance.

In order to improve the ink depleting performance and prevent entry of air into the ink supplying path, the present inventors are examining the use of the above-described ink cartridge proposed by the inventors in the inkjet printer main unit as described in JP-A-2005-66906 including the sub tank opened to the atmosphere and disposed between the ink cartridge and the ink supplying path. FIGS. 6A to 6D show the inkjet printer device that is being examined and shows vertical sectional views of states where an ink cartridge 929 is mounted to a main printer unit 903A. The ink cartridge 929 includes an ink storage chamber 943 and an ink supplying chamber 945 and having a communicating port 948*a* disposed at a position lower than an ink supplying port 950*a*. The main printer unit 903A including a sub tank 927 with the above-described arrangement. In addition, a volume of the ink cartridge 929 is adequately large with respect to a volume of the sub tank 927. When a new ink cartridge 929 is mounted, an ink 100 flows from the ink cartridge 929 into an internal space 970 of the sub tank 927 due to a hydraulic head pressure, such that, as shown in FIG. 6A, a liquid level inside the ink storage chamber 943 and a liquid level in the sub tank internal space 970 become matched at the same height. These liquid levels fall and are kept at the same height, in accordance with ejection of the ink by the head. Thereafter, as shown in FIG. 6B, the liquid levels reach an ink inflow port 973*a* of the sub tank 943, that is, a height position of an ink supplying port 950*a* of the ink cartridge 929. When ink is ejected in this state, air enters from the ink inflow port 973*a* into the ink supplying chamber 945 side, and the ink 100 stored in a space at an upper side of the ink supplying port 950*a* in the ink storage chamber 945 is consumed. Thereafter, as shown in FIG. 6*c*, the liquid level in the ink supplying chamber 945 reaches the height of the ink supplying port 950*a*. When ink is ejected in this state, the ink in the sub tank 927 is consumed, and ink can be supplied to the head until the liquid level in the sub tank 927 falls to a height position of an ink outflow port 976*a*.

Meanwhile, the liquid level in the ink storage chamber 943 does not fall from the state shown in FIG. 6B, and the ink 100 that cannot be used up and remains below the ink supplying port 950*a*. That is, even if the ink cartridge 929 has the ink storage chamber 943, the ink supplying chamber 945, and the communicating port 948*a* in order to improve the ink depleting performance, this structure cannot be effectively used.

One aspect of the invention is conceived in view of the above, and has an object to provide a liquid ejection device having a sub tank opened to an atmosphere and into which the liquid from the liquid cartridge flows due to a hydraulic head pressure, with an improved liquid depleting performance of a liquid in a liquid cartridge.

According to an aspect of the invention, there is provided a liquid ejection device comprising: a liquid cartridge having a liquid supply port through which a liquid contained in the liquid cartridge is allowed to be supplied to an outside of the liquid cartridge, a liquid supply chamber defined in the liquid cartridge and configured to communicate with the outside through the liquid supply port, and a first liquid storage chamber defined in the liquid cartridge and configured to communicate with the liquid supply chamber via a first communicating port; and a main unit comprising a liquid ejection head configured to eject the liquid, a mounting unit to which the liquid cartridge is removably mounted, and a sub tank configured to allow fluid communication between the liquid cartridge and the liquid ejection head, wherein the sub tank has: a liquid inflow port connectable to the liquid supply port of the liquid cartridge in a state where the liquid cartridge is mounted to the mounting unit; a liquid outlet port through which the liquid contained in the sub tank is allowed to flow out toward the liquid ejection head; a liquid inflow chamber configured to communicate with the outside of the main unit through the liquid inlet port, the liquid inflow chamber allowing the liquid to be supplied from the liquid cartridge through the liquid inflow port in the state where the liquid cartridge is mounted to the mounting unit; a second liquid storage chamber configured to communicate with the liquid inflow chamber through a second communicating port and to store the liquid supplied from the liquid inflow chamber, the liquid stored in the second liquid storage chamber being allowed to flow out to the liquid ejection head through the liquid outflow port; and an atmosphere opening port configured to allow the second liquid storage chamber to communicate with an atmosphere, and wherein the first communicating port, the second communicating port, and the liquid outflow port are positioned lower than the liquid supply port in the state where the liquid cartridge is mounted to the mounting unit.

According to another aspect of the invention, there is provided a liquid ejection device to which a liquid cartridge is removably mountable, the liquid cartridge having a liquid supply port through which a liquid contained in the liquid cartridge is allowed to be supplied to an outside of the liquid cartridge, said liquid ejection device comprising; a liquid ejection head configured to eject the liquid; a mounting unit to which the liquid cartridge is removably mountable; and a sub tank configured to allow fluid communication between the liquid cartridge and the liquid ejection head in a state where the liquid cartridge is mounted to the mounting unit, wherein the sub tank has: a liquid inflow port connectable to a liquid supply port of the liquid cartridge in the state where the liquid cartridge is mounted to the mounting unit; a liquid outflow port through which the liquid contained in the sub tank is allowed to flow out toward the liquid ejection head; a liquid inflow chamber configured to communicate with the outside of the sub tank through the liquid inflow port, the liquid inflow chamber allowing the liquid to be supplied from the liquid cartridge through the liquid inflow port in the state where the liquid cartridge is mounted to the mounting unit; a second liquid storage chamber configured to communicate with the liquid inflow chamber through a second communicating port and to store the liquid supplied from the liquid inflow chamber, the liquid stored in the second liquid storage chamber being allowed to flow out to the liquid ejection head through the liquid outflow port; and an atmosphere opening port configured to allow the second liquid storage chamber to communicate with an atmosphere, and wherein the second communicating port and the liquid outflow port are positioned lower than the liquid supply port in the state where the liquid cartridge is mounted to the mounting unit.

DESCRIPTION

Figure 1:
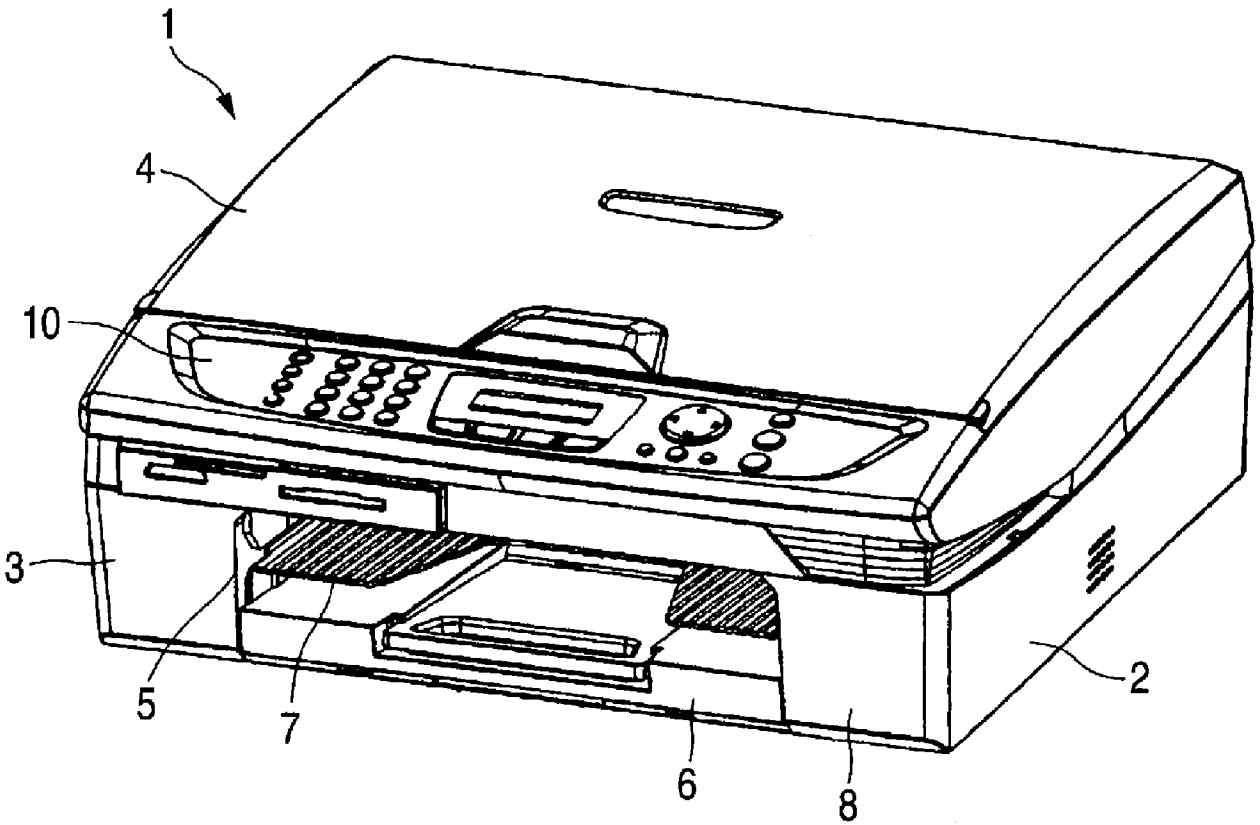
FIG. 1 is a perspective view of a multi function device having a printer main unit (device main unit) of an inkjet printer (liquid ejection device) according to a first embodiment of the present invention.

Embodiments according to the present invention will be described with reference to the drawings. FIG. 1 is a perspective view of a multi function device 1 having a printer main unit 3A (device main unit, liquid ejection device main unit) according to a first embodiment of the present invention. As shown in FIG. 1, the multi function device 1 has a printer function, a scanner function, a copying function, and a facsimile function, and includes the printer main unit 3A disposed at a lower portion of a housing 2 thereof and a scanner 4 disposed at an upper portion of the housing 2. An opening 5 is formed on a front surface of the housing 2, a sheet feeding tray 6 of the printer main unit 3A is disposed at a lower stage of the opening 5, and a sheet discharging tray 7 of the printer main unit 3A is disposed at an upper stage. An opening/closing cover 8 is disposed at a lower right portion of a front side of the printer main unit 3A, and a main tank mounting unit 28 (see FIG. 2) is disposed at an inner side of the opening/closing cover 8 is disposed The main tank mounting unit 28 allows thereto a main tank 29 (liquid cartridge) is removably mounted. An inkjet printer 3 (liquid ejection device) can work by mounting the main tank 29 to the main tank mounting unit 28 of the printer main unit 3A. An operator panel 10 for operation of the printer main unit 3A, the scanner 4, etc are disposed on an upper front side of the multi function device 1. In addition, the multi function device 1 is connectable to an external personal computer 11 (see FIG. 2) and is operable based on instructions transmitted from the personal computer 11 via a driver.

Figure 2:
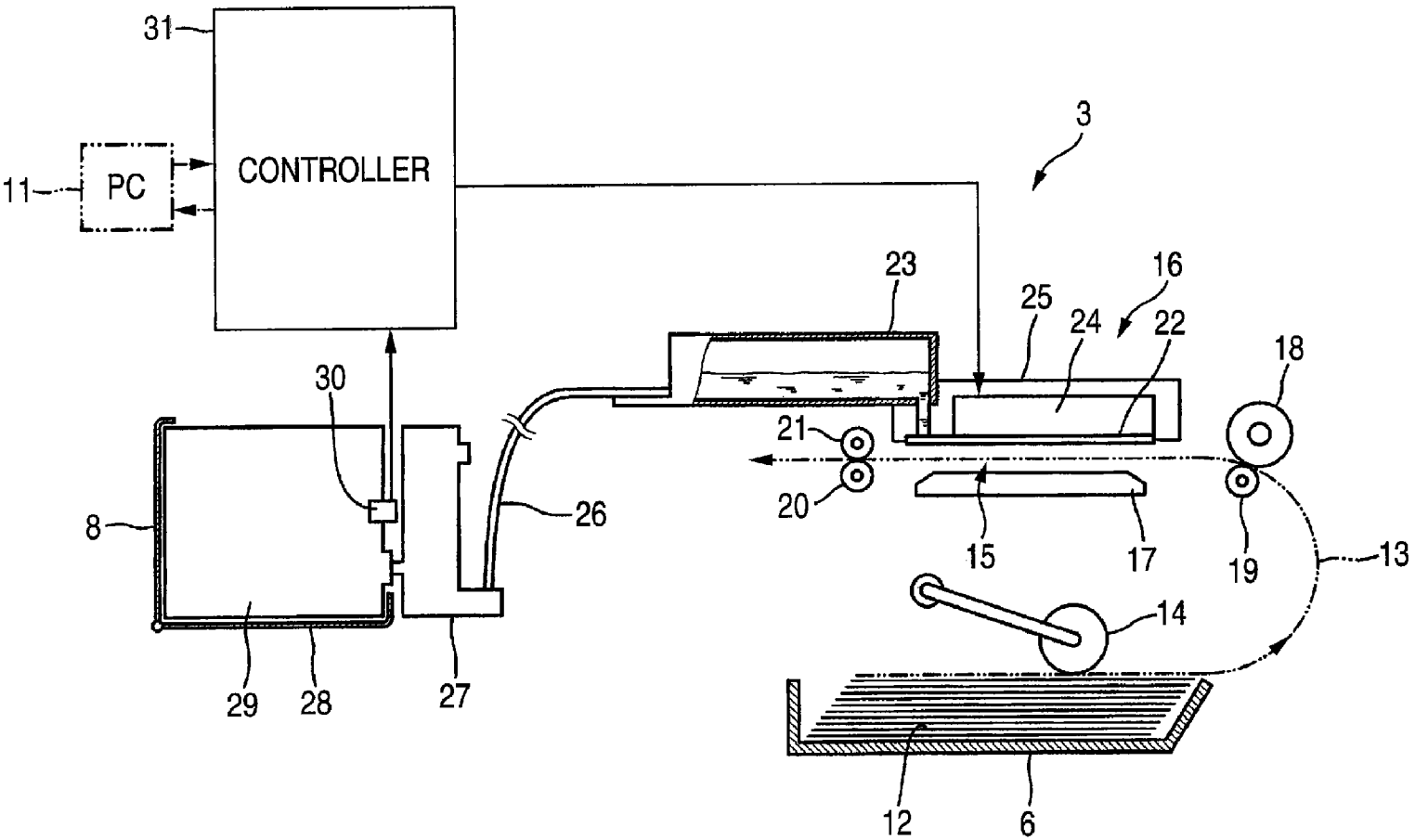
FIG. 2 is a schematic partial sectional view of the multi function device showing the inkjet printer with a main tank (liquid cartridge) mounted to the printer main unit.

FIG. 2 is a schematic partial sectional view showing the inkjet printer 3 shown in FIG. 1. As shown in FIG. 2, the sheet feeding tray 6 is disposed at a bottom side of the multi function device 1. A sheet feeding drive roller 14 is disposed at an upper side of the sheet feeding tray 6 and configured to feed a sheet at a topmost layer of recording sheets 12 placed on the sheet feeding tray 6 to a conveying path 13. The conveying path 13 rises upward from a back side of the sheet feeding tray 6, then turns back toward a front side, passes a printing region 15, and leads to the sheet discharging tray 7.

An image recording unit 16 is disposed at the printing region 15. A platen 17 having larger size than a sheet is disposed below the image recording unit 16. A conveying roller 18 and a pinch roller 19 are disposed at an upstream side of the image recording unit 16 with respect to the conveying path 13 and configured to nip a recording sheet 12 fed from the sheet feeding tray 6 and convey the sheet onto the platen 17. A sheet discharging roller 20 and a pinch roller 21 are disposed at a downstream side of the image recording unit 16 and configured to nip the recording sheet 12 on which printing has been performed and convey the sheet to the sheet discharging tray 7 (see FIG. 1).

The image recording unit 16 includes: an inkjet head 22 (liquid ejection head) of piezoelectric driven type which ejects ink (liquid) toward the platen 17 from a plurality of nozzles: a buffer tank 23 capable of storing the ink to be supplied to the inkjet head 22; a head control board 24 configured to perform drive control of the inkjet head 22; and a carriage 25 on which these elements are mounted. The buffer tank 23 is connected to a sub tank 27, as described later, via an ink supplying tube 26. The ink may be directly supplied from the ink supplying tube 26 to the inkjet head 22 without providing the buffer tank 23. The main tank mounting unit 28 is disposed at a position adjacent to the sub tank 27. The opening/closing cover 8 is attached to the main tank mounting unit 28. The main tank mounting unit 28 is provided with a remaining amount detecting sensor 30 that optically detects a remaining ink amount in the main tank 29 in a state where the main tank 29 is mounted.

The remaining amount detecting sensor 30 is connected to a controller 31. The controller 31 is configured to perform the task of detecting the remaining ink amount in the main tank 29, and in addition, the controller 31 is configured to execute operation control of ink ejection from the inkjet head 22, feeding and discharging the recording sheet 12, and various other tasks of the inkjet printer 3. The controller 31 includes a CPU (central processing unit), a ROM configured to store program executed by the CPU and data used in the program, a RAM configured to temporarily store data during execution of a program, a rewritable EEPROM or other memory, an input/output interface connectable to external devices such a personal computer 11, etc. The operator can transmit image information to be recorded by the inkjet printer 3 to the controller 31 by use of the personal computer 11, and receive information on remaining ink amount from the controller 31.

Figure 3:
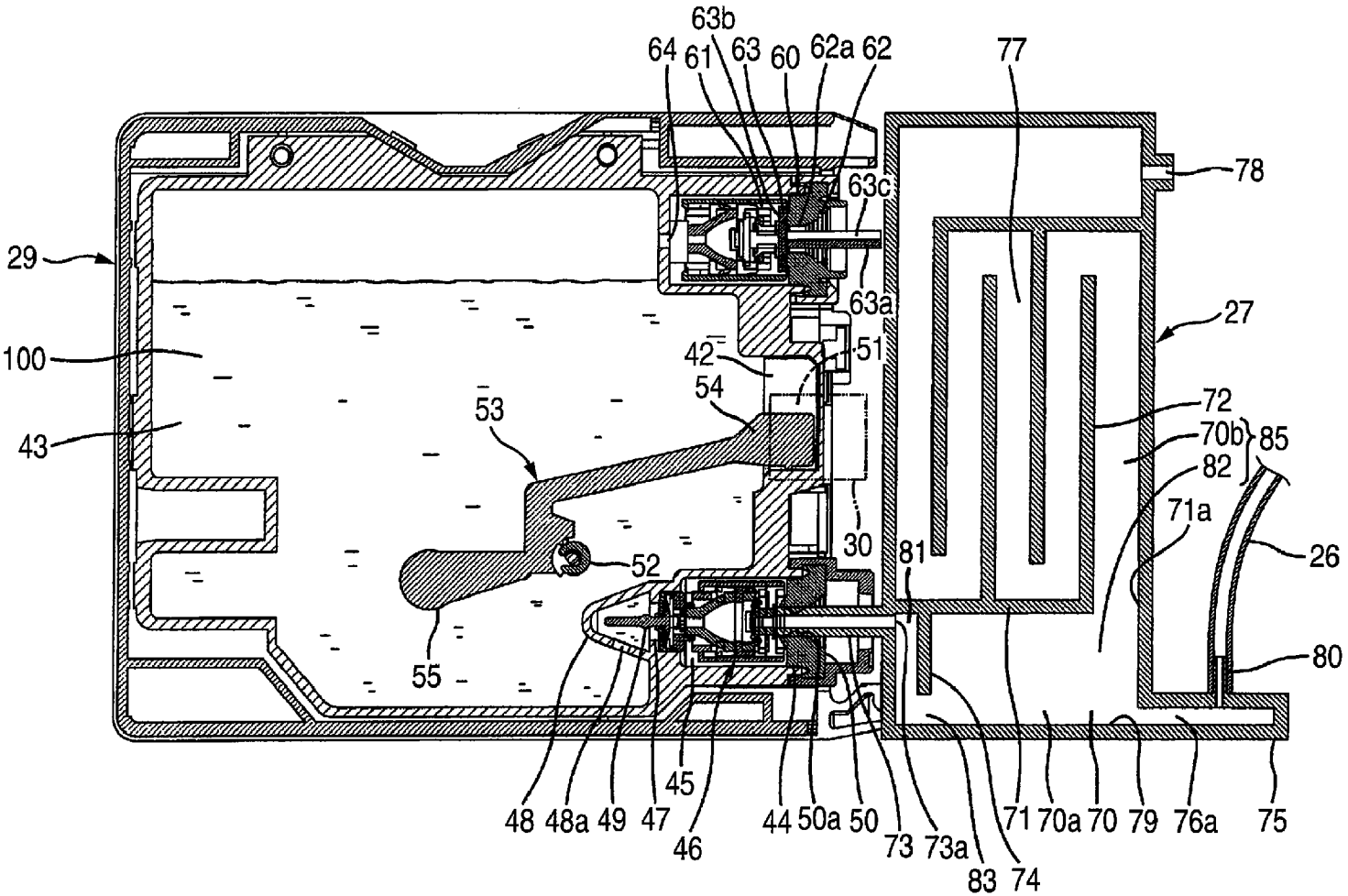
FIG. 3 is a vertical sectional view of the main tank and a sub tank of the inkjet printer shown in FIG. 2.

FIG. 3 is a vertical sectional view of the main tank 29 and the sub tank 27 of the inkjet printer 3 shown in FIG. 2.

As shown in FIG. 3, the main tank 29 has a first ink storage chamber 43 capable of storing ink 100. As shown in FIG. 3, an opening 44 and a tubular valve housing chamber 45 continuous with the opening 44 are provided at a lower portion of a surface (at the right side in FIG. 3) of the main tank 29 opposing the sub tank 27. The valve housing chamber 45 extends from the opening 44 toward inside the main tank 29, and an ink supplying valve 46 is housed in the valve housing chamber 45. A valve port 47 is formed on an inner surface of the valve housing chamber 45, and a hollow, conical cover portion 48 is protruded from a circumference of the valve port 47 toward the inside the main tank 29. A first communicating port 48*a* is formed at a lower portion of the cover portion 48, and the valve housing chamber 45 is brought into fluid communication with the first ink storage chamber 43 via the valve port 47 and the first communicating port 48*a*. The valve port 47 is provided with a check valve 49, and the check valve 49 opens the valve port 47 when the first ink storage chamber 43 becomes positive in pressure with respect to the valve housing chamber 45 and closes the valve port 47 when the first ink storage chamber 43 becomes negative in pressure with respect to the valve housing chamber 45. An annular sealing member 50 is disposed at the opening 44, and an ink supplying port 50*a* (liquid supplying port) is formed at a center portion of the sealing member 50. The diameter of the ink supplying port 50*a* is reduced by elastic force in a non-loaded state. The valve housing chamber 45 and the first ink storage chamber 43 can be brought into fluid communication with the outside of the main tank 29 via the ink supplying port 50*a*.

A sensor arm 53 is swingably supported by a supporting portion 52 in the interior of the main tank 29. A float portion 55 capable of floating on a liquid surface of the ink is disposed at one end of the sensor arm 53, and a blocking portion 54 is disposed at the other end of the sensor arm 53. In addition, at a sub tank 27 side portion of the main tank 29, a recess 42 is formed continuously to the first ink storage chamber 43. In a state where the main tank 29 is mounted to the main tank mounting unit 28, the recess 42 is sandwiched between a light emitting element and a light receiving element of the remaining amount detecting sensor 30, Two light transmitting portions 51 formed of a semitransparent material enabling transmission of light from the light emitting element are disposed at both side walls of the recess 42. When the remaining ink amount in the first ink storage chamber 43 is high, the blocking portion 54 contacts a bottom surface of the recess 42 and swinging of the sensor arm 53 is thereby restricted. In this state, the blocking portion 54 is positioned between both light transmitting portions 51 so that the light emitted from the light emitting element does not reach the light receiving element, and a detection signal indicating that an adequate amount of ink is left is input into the controller 31. When the remaining ink amount inside the first ink storage chamber 43 becomes low, the float portion 55 falls in accordance with the falling of the liquid level and the blocking portion 54 retreats out of the recess 42. In this state, the light from the light emitting element is transmitted through the light transmitting portions 51 and reaches the light receiving element, and a detection signal indicating that the remaining ink amount has decreased to a predetermined value is input into the controller 31.

An opening 60 and a tubular valve chamber 61 continuous with the opening 60 are disposed at an upper portion of the surface of the main tank 29 opposing the sub tank 27. An annular sealing member 62 is disposed at the opening 60, and an atmosphere opening port 62*a* is formed at a center of the sealing member 62. The valve housing chamber 61 extends from the opening 60 toward inside the main tank 29, and an atmosphere opening valve 63 is housed in the valve housing chamber 61. The atmosphere opening valve 63 includes: a rod portion 63*a* that penetrates through the atmosphere port 62*a* and protrudes toward the sub tank 27 side; and a flange portion 63*b* that projects in outward radial directions from an inner end portion of the rod portion 63*a*. The atmosphere opening valve 63 is urged so that the flange portion 63*b* contacts the sealing member 62 and thereby seals the atmosphere opening port 62*a*. A groove portion 63*c* is disposed along a direction of extension of the rod portion 63*a*, and in a state where the flange portion 63*b* is separated from the sealing member 62, the valve housing chamber 61 is open to an atmosphere via the groove portion 63*c*. A communication port 64 is formed at an inner surface of the valve housing chamber 61, and the valve housing chamber 61 is brought into fluid communication via the communication port 64 with an air layer formed at an upper portion of the first ink storage chamber 43.

As shown in FIG. 3, the sub tank 27 has a lower region 70*a* and an upper region 70*b* as an internal space 70 of the sub tank 27. An upper portion of the lower region 70*a* terminates at an upper wall portion 71, and a vertical communicating port 71*a* is formed in a portion of the upper wall portion 71. A tubular portion 72 forming the upper region 70*b* protrudes upward from a circumference of the vertical communicating port 71*a*. A horizontal cross-sectional area of the upper region 70*b* is thus significantly smaller than a horizontal cross-sectional area of the lower region 70*a*. A tubular needle portion 73 is protruded toward the main tank 29 side from an outer wall of the sub tank 27, and the needle portion 73 has an ink inflow port 73*a* (liquid inflow port) that opens toward the lower region 70*a*. By inserting the needle portion 73 in the ink supplying port 50*a* of the sealing member 50 of the main tank 29, the lower region 70*a* of the internal space 70 of the sub tank 27 communicates with the valve housing chamber 45 and the first ink storage chamber 43 of the main tank 29. Furthermore, on an outer wall of the sub tank 27, a protrusion 75 is protruded in a direction away from the main tank 29. The protrusion 75 has a space therein which constitutes a portion of the lower region 70*a* and includes a tubular tube attachment portion 80 configured to communicate with this space protrudes from an upper wall of the protrusion 75. The tube attachment portion 80 has an ink outflow port 76*a* (liquid outflow port) opening toward the lower region 70*a*. By connecting the ink supplying tube 26 to the tube mounting portion 80, the lower region 70*a* of the internal space 70 of the sub tank 27 communicates with the buffer tank 23 (see FIG. 2) of the image recording unit 16 via the ink supplying tube 26. In addition, the sub tank 27 has a labyrinth flow path 77 that continues to an upper end of the tubular portion 72 and communicates with the upper region 70*b*. The labyrinth flow path 77 communicates with an atmosphere opening port 78 formed at an upper portion of the sub tank 27, and the internal space 70 is opened to the atmosphere by the atmosphere opening port 78.

In addition, in the sub tank 27, a flow path wall 74 vertically extends downward from the upper wall portion 71 at a position opposite the ink inflow port 73*a*. The flow path wall 74 partitions the lower region 70*a* into an ink inflow chamber 81 and an ink outflow chamber 82. The ink inflow port 73*a* provided at the ink inflow chamber 81, and vertical communicating port 71*a* and the ink outflow port 76*a* are provided at the ink outflow chamber 82. The two chambers 81 and 82 communicates with each other through a second communicating port 83 that is formed in the vicinity of a flush bottom surface 79 of both chambers 81 and 82. The second communicating port 83 is formed as a slit extending between a lower end of the flow path wall 74 and the bottom surface 79.

As shown in FIG. 3, the first communicating port 48*a* is positioned lower than the ink supplying port 50*a*. In a state where the main tank 29 is mounted to the main tank mounting unit 28, the ink inflow port 73*a* is positioned at the same height as the ink supplying port 50*a*. The second communicating port 83 and the ink outflow port 76*a* are positioned lower than the first communicating port 98*a*. In addition, an upper end position of the ink outflow port 76*a* is positioned lower than an upper end position of the second communicating port 83.

Figure 4A:
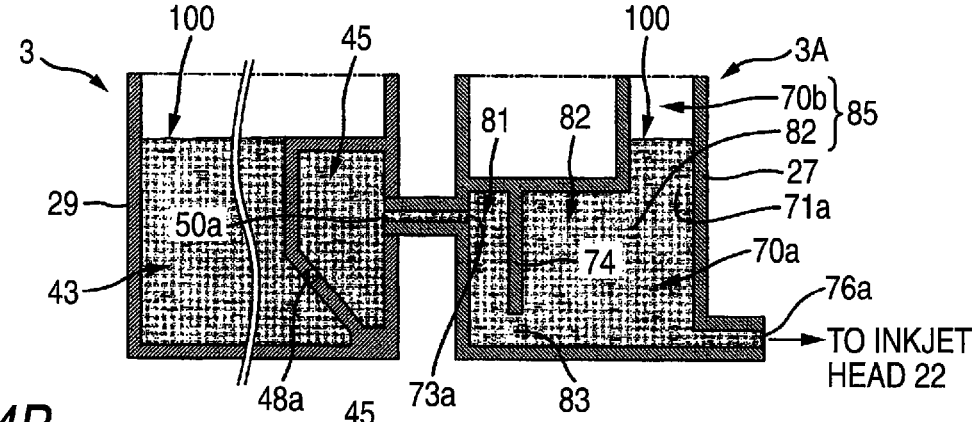
FIGS. 4A to 4D show diagrams corresponding to a schematic view of FIG. 3 and showing changes of liquid levels of ink in the main tank and the sub tank in accordance with ink ejection by an inkjet head.

FIGS. 4A to 4D show schematic views of FIG. 3 that are diagrams of changes of the liquid levels of the ink 100 in the main tank 29 and the sub tank 27 in accordance with ink ejection by the inkjet head 22. In addition, a volume of the ink cartridge 29 is adequately large with respect to a volume of the sub tank 27. A new ink cartridge 29 stores the ink 100 in the interior of the first ink storage chamber 43, and the interior of the valve housing chamber 45 is filled with the ink. The liquid level of the ink is positioned above the ink supplying port 50*a*. When this new main tank 29 is mounted to the main tank mounting unit 28, the needle portion 73 is inserted into the ink supplying port 50*a*, the ink supplying valve 46 and the check valve 49 become open, and the first ink storage chamber 43 and the valve housing chamber 45 of the main tank 29 are brought into fluid communication with the ink storage space 70 of the sub tank 27. The ink storage space 70 of the sub tank 27 communicates with the atmosphere via the atmosphere opening port 78. In the main tank 29, the atmosphere opening valve 63 is opened by the rod portion 63*a* being pressed against the sub tank 27 and the first ink storage chamber 43 is thereby opened to the atmosphere. Therefore, even if air enters into the needle portion 73 when mounting of the main tank 29, this air flows into the ink storage space 70 of the sub tank 27 and escapes to the atmosphere, and the ink 100 flows smoothly from the main tank 29 side into the sub tank 27 side. Here, by the hydraulic head pressure, in the sub tank 27, the liquid level inside the first ink storage chamber 43 falls while the interior of the valve housing chamber 45 is kept filled with the ink. On the other hand, in the sub tank 27, the liquid level in the lower region 70*a* rises by the hydraulic head pressure. When the liquid level in the sub tank 27 reaches the upper wall portion 71 (that is, when the interior of the ink inflow chamber 81 becomes filled with the ink), the liquid level rises inside the upper region 70*b* that communicates with the lower region 70*a* via the vertical communicating port 71*a*. The ink 100 flows into the sub tank 27 side until the liquid level inside the first storage chamber 43 becomes matched in height with the liquid level inside the upper region 70*b* as shown in FIG. 4A. In the embodiments, the ink outflow chamber 82 of the lower region 70*a* and the upper region 70*b*, which communicates with each other through the vertical communicating port 71*a*, are referred to as a second ink storage chamber 85 (second liquid storage chamber).

Figure 4B:
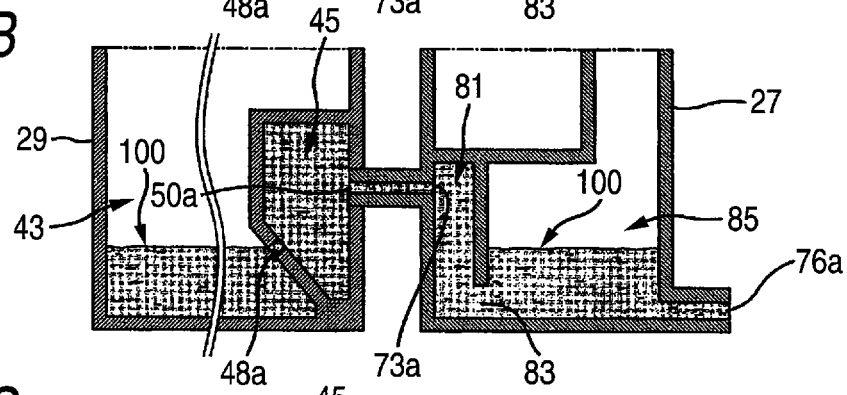

When ink is ejected by the inkjet head 22 in this state, because ink of an amount corresponding to the ejected amount flows from the second ink storage chamber 85 to the ink supplying tube 26, the liquid levels in the first and second ink storage chambers 43 and 85 fall while being matched in height. In addition, in the sub tank 27, after the liquid level in the second ink storage chamber 85 falls to the height position of the vertical communicating port 71*a*, the liquid level in the ink inflow chamber 81 stops falling due to the effect of the flow path wall 74 and only the liquid level in the second ink storage chamber 85 (ink outflow chamber 82) falls further. Meanwhile, in the main tank 29, after the liquid level in the first ink storage chamber 43 falls to the height position of the ink supplying port 50*a*, only the liquid level within the first ink storage chamber 43 falls further, while the interior of the valve housing chamber 45 is kept filled with ink. The liquid levels in the first and second ink storage chambers 43 and 85 then pass below the height position of the ink supplying port 50*a* and reach an upper end position of the first communicating port 48*a* as shown in FIG. 4B.

Figure 4C:
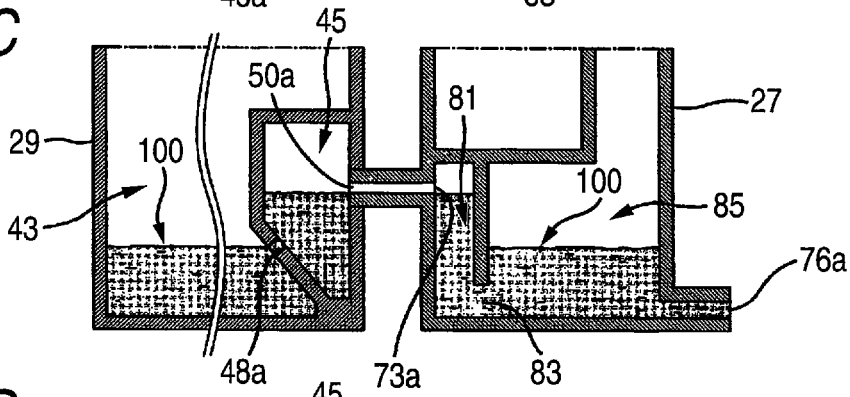

When the ink is ejected by the inkjet head 22 in this state, the ink stored in a space above the ink supplying port 50*a* in the valve housing chamber 45 and in a space above the ink inflow port 73*a* in the ink inflow chamber 81 is consumed. Thereafter, as shown in FIG. 4C, the liquid levels in the valve housing chamber 45 and the ink inflow chamber 81 both fall to the height position of the ink supplying port 50*a* (ink inflow port 73*a*).

Figure 4D:
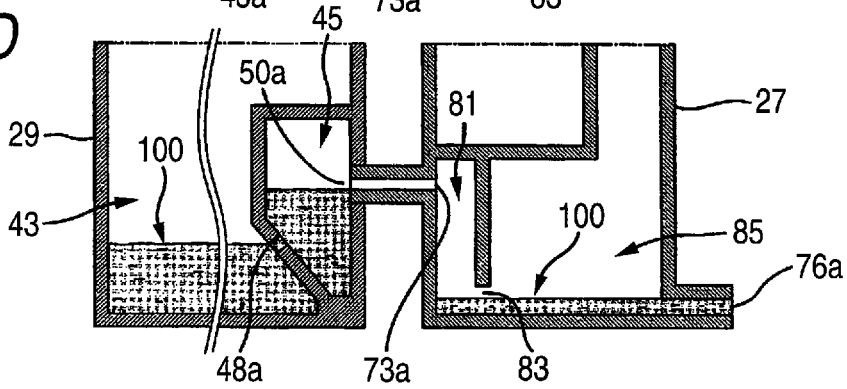

When the ink is ejected by the inkjet head 22 in this state, the ink inside the main tank 29 cannot be used and only the liquid level in the ink inflow chamber 81 falls. The ink inside the sub tank 27 can be used until the liquid level therein falls to an upper end position of the ink outflow port 76*a* as shown in FIG. 4D.

According to the configuration described above, the inkjet printer 3 (printer main unit 3A) includes the sub tank 27 that is opened to the atmosphere through the atmosphere communicating port 78, thereby the atmosphere communication port 76 allows air entered at the mounting of the main tank 29 to be released. In addition, the ink storage space 70 of the sub tank 27 has the ink inflow chamber 81 with the ink inflow port 73*a*, and the second ink storage chamber 85 with the ink outflow port 76*a*, and the second ink storage chamber 85 communicates with the ink inflow chamber 81 through the second communicating port 83. Since the second communicating port 83 and the ink outflow port 76*a* are positioned lower than the first communicating port 48*a*, the liquid level in the first ink storage chamber 43 can be lowered to the upper end position of the first communicating port 48*a*. The inkjet printer 3 (printer main unit 3A) can be provided with good ink depletion performance.

In addition, since the upper end position of the ink outflow port 76*a* is formed lower than the upper end position of the second communicating port 83, the ink depletion performance in the sub tank 27 can be improved. Furthermore, since the second communicating port 83 is positioned in the vicinity of the bottom surface 79 of the sub tank 29, the ink depletion performance in the sub tank 27 can likewise be improved.

FIGS. 5A to 5D show diagrams of changes of liquid levels in an inkjet printer 103 according to a second embodiment of the present invention. As shown in FIGS. 5A to 5D, a flow path wall 174 is disposed in a sub tank 127 of a printer main unit 103A and formed to reach the bottom surface 79, and a second communicating port 183 is formed so as to penetrate through the flow path wall 174. The second communicating port 183 is positioned lower than the ink supplying port 50*a* but is positioned higher than the first communicating port 48*a*. Other configurations of the second embodiment are the same as those of the first embodiment, and the portions that are the same shall be provided with the same symbols and description relating to the same configurations is omitted.

Figure 5A:
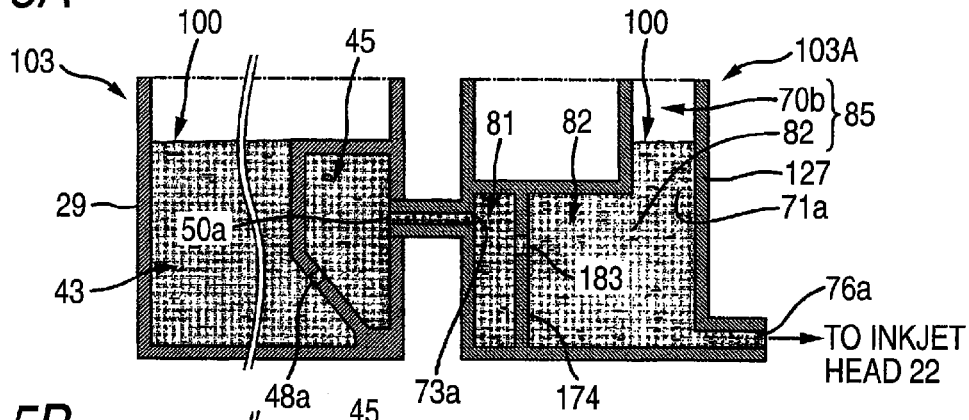
FIGS. 5A to 5D show diagrams of changes of liquid levels of ink in a main tank and a sub tank in accordance with ink ejection by an inkjet head in an inkjet printer according to a second embodiment of the present invention.
Figure 5B:
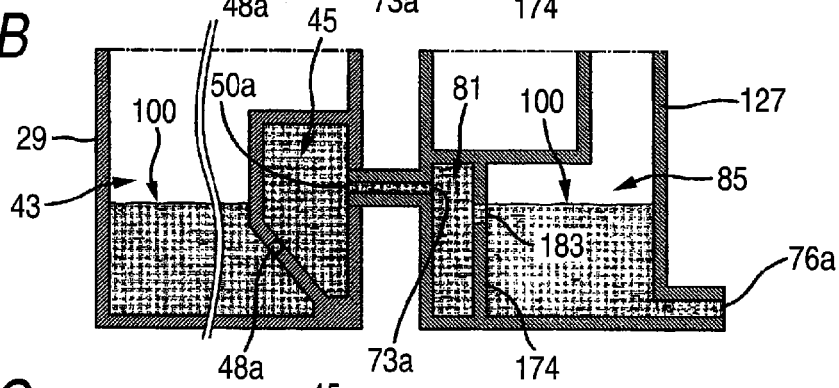

The main tank 29 is removably mountable to the main tank mounting unit 28 of the printer main unit 103A in the second embodiment as well. When a new main tank (new liquid cartridge) is mounted to the main tank mounting unit 28, the ink stored in the first ink storage chamber 43 flows into the second ink storage chamber 85 via the valve housing chamber 45 and the ink inflow chamber 81. The liquid level in the first ink storage chamber 43 thereby falls, while the valve housing chamber 45 is kept being filled with ink. In this state, the ink inflow chamber 81 becomes filled with ink, the liquid level in the second ink storage chamber 85 rises, and the liquid levels in the first and second ink storage chambers 43 and 85 become matched in height as shown in FIG. 5A. When ink is ejected by the inkjet head 22 in this state, only the liquid levels in the first and second ink storage chambers 43 and 85 fall, and thereafter, as shown in FIG. 5B, the liquid levels in both chambers 43 and 85 fall until the height position of the ink supplying port 50*a* to an upper end position of the second communicating port 183.

Figure 5C:
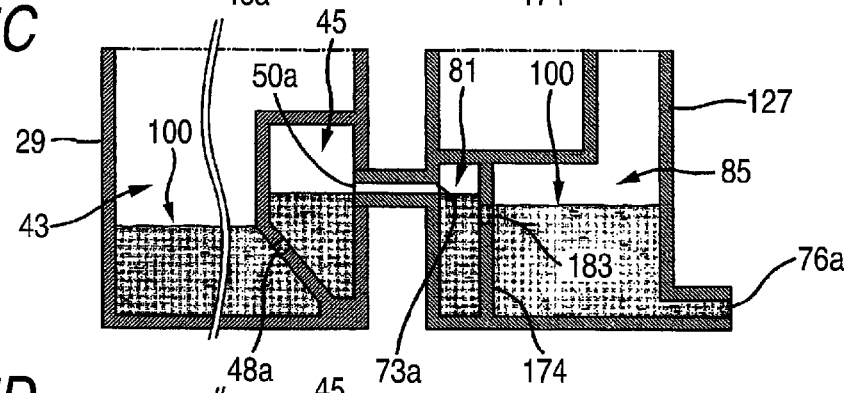

When the ink is ejected by the inkjet head 22 in this state, the ink stored in the space above the ink supplying port 50*a* in the valve housing chamber 45 and in the space above the ink inflow port 73*a* in the ink inflow chamber 81 is consumed. Thereafter, as shown in FIG. 5C, the liquid levels in the valve housing chamber 45 and the ink inflow chamber 81 both fall to the height position of the ink supplying port 50*a* (ink inflow port 73*a*).

Figure 5D:
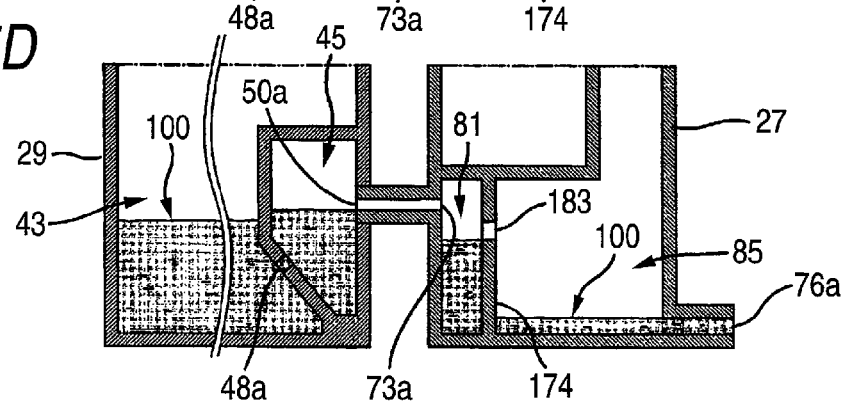
Figure 6A:
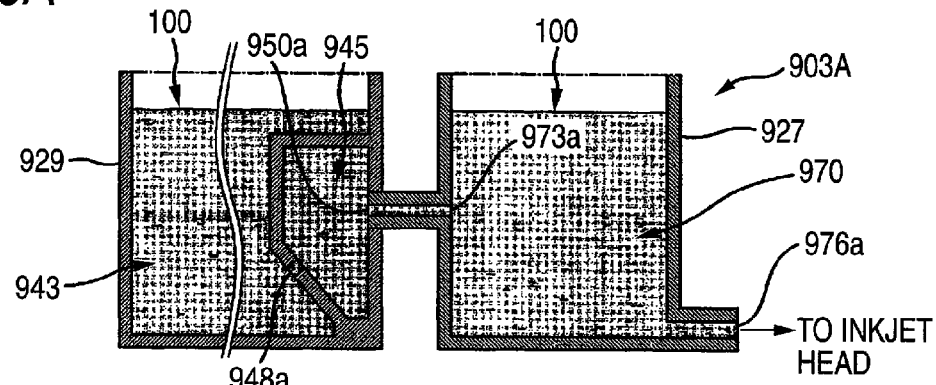
FIGS. 6A to 6D show diagrams of changes of liquid levels of ink in a main tank and a sub tank in accordance with ink ejection by an inkjet head in a proposed inkjet printer.
Figure 6B:
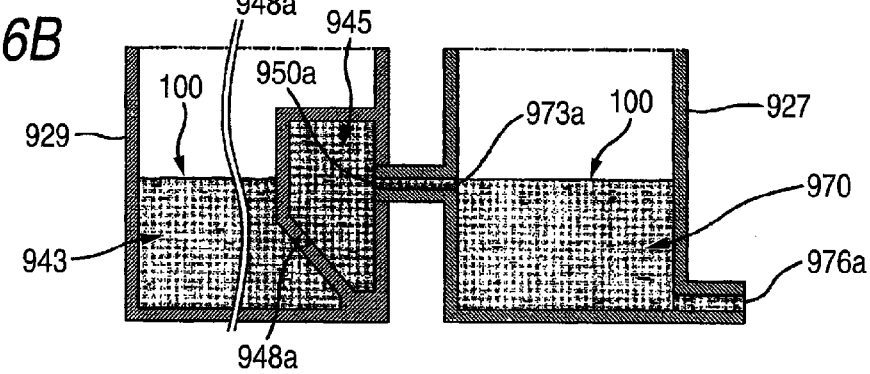
Figure 6C:
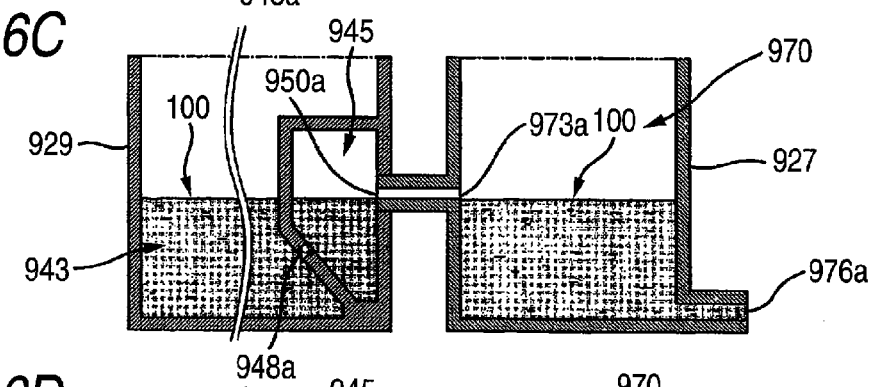
Figure 6D:
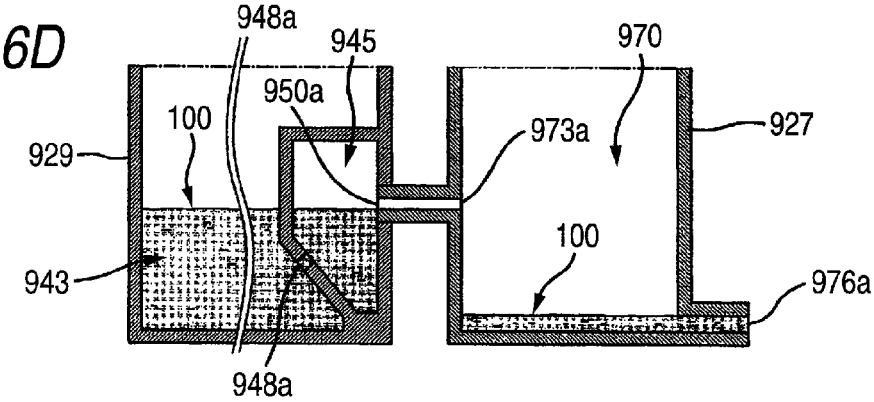

When the ink is ejected by the inkjet head 22 in this state, the ink inside the main tank 29 cannot be used and the liquid level in the ink inflow chamber 81 falls to a lower end position of the second ink communicating port 183. The ink stored in the sub tank 127 (ink outflow chamber 82) can be used until the liquid level therein falls to the upper end position of the ink outflow port 76*a* as shown in FIG. 5D.

Accordingly, the liquid level in the first ink storage chamber 43 can be lowered at least lower than the ink supplying port 50*a* and the ink depletion performance is improved with the second embodiment as well.

The scope of the present invention is not limited to the first and the second embodiments, and the present invention may include various modification of the inkjet printer including the first communicating port, the second communicating port, and the ink outflow part which are positioned lower than the ink supplying port (ink inflow port). Also, although in the first and second embodiments, the atmosphere opening port 78 is open at all times, the present invention is not limited thereto, and a valve configured to selectively open and close the atmosphere opening port 78 may be provided and may be opened and closed as necessary. For example, the valve closes when the main tank 29 is not mounted to the main tank mounting unit 28 and opens when the main tank 29 is mounted. Also, although the liquid ejection device was described as being an inkjet printer, the present invention can be applied to other liquid ejection deices in which a liquid is supplied from a cartridge. Further, although the second communicating port 83 is positioned lower than the first communicating port 48*a* in the above embodiments, the second communicating port 83 may be positioned at the same height or lower than the first communicating port 48*a*.

What is claimed is:

1. A liquid ejection device comprising:

a liquid cartridge having;

a liquid supply port through which a liquid contained in the liquid cartridge is allowed to be supplied to an outside of the liquid cartridge;

a liquid supply chamber defined in the liquid cartridge and configured to communicate with the outside through the liquid supply port; and a first liquid storage chamber defined in the liquid cartridge and configured to communicate with the liquid supply chamber via a first communicating port; and a main unit comprising:

a liquid ejection head configured to eject the liquid;

a mounting unit to which the liquid cartridge is removably mounted; and a sub tank configured to allow fluid communication between the liquid cartridge and the liquid ejection head, wherein the sub tank has:

a liquid inflow port connectable to the liquid supply port of the liquid cartridge in a state where the liquid cartridge is mounted to the mounting unit;

a liquid outlet port through which the liquid contained in the sub tank is allowed to flow out toward the liquid ejection head;

a liquid inflow chamber configured to communicate with the outside of the main unit through the liquid inlet port, the liquid inflow chamber allowing the liquid to be supplied from the liquid cartridge through the liquid inflow port in the state where the liquid cartridge is mounted to the mounting unit:

a second liquid storage chamber configured to communicate with the liquid inflow chamber through a second communicating port and to store the liquid supplied from the liquid inflow chamber, the liquid stored in the second liquid storage chamber being allowed to flow out to the liquid ejection head through the liquid outflow port; and an atmosphere opening port configured to allow the second liquid storage chamber to communicate with an atmosphere, and wherein the first communicating port, the second communicating port, and the liquid outflow port are positioned lower than the liquid supply port in the state where the liquid cartridge is mounted to the mounting unit.

2. The liquid ejection device according to claim 1, wherein the second communicating port is positioned at the same height or lower than the first communicating port in the state where the liquid cartridge is mounted to the mounting unit.

3. The liquid ejection device according to claim 1, wherein the liquid outflow port is positioned at the same height or lower than the first communicating port in the state where the liquid cartridge is mounted to the mounting unit.

4. The liquid ejection device according to claim 1, wherein the liquid outflow port is positioned at the same height or lower than the second communicating port.

5. The liquid ejection device according to claim 1, wherein the second communicating port is formed to extend from a bottom surface of the liquid inflow chamber and a bottom surface of the second liquid storage chamber.

6. A liquid ejection device to which a liquid cartridge is removably mountable, the liquid cartridge having a liquid supply port through which a liquid contained in the liquid cartridge is allowed to be supplied to an outside of the liquid cartridge, said liquid ejection device comprising:

a liquid ejection head configured to eject the liquid;

a mounting unit to which the liquid cartridge is removably mountable; and a sub tank configured to allow fluid communication between the liquid cartridge and the liquid ejection head in a state where the liquid cartridge is mounted to the mounting unit, wherein the sub tank has:

a liquid inflow port connectable to a liquid supply port of the liquid cartridge in the state where the liquid cartridge is mounted to the mounting unit;

a liquid outflow port through which the liquid contained in the sub tank is allowed to flow out toward the liquid ejection head;

a liquid inflow chamber configured to communicate with the outside of the sub tank through the liquid inflow port, the liquid inflow chamber allowing the liquid to be supplied from the liquid cartridge through the liquid inflow port in the state where the liquid cartridge is mounted to the mounting unit;

a second liquid storage chamber configured to communicate with the liquid inflow chamber through a second communicating port and to store the liquid supplied from the liquid inflow chamber, the liquid stored in the second liquid storage chamber being allowed to flow out to the liquid ejection head through the liquid outflow port; and an atmosphere opening port configured to allow the second liquid storage chamber to communicate with an atmosphere, and wherein the second communicating port and the liquid outflow port are positioned lower than the liquid supply port in the state where the liquid cartridge is mounted to the mounting unit.

* * * * *